313-414 3R
2/12/85 OR 4,499,402

United States Patent [19]

van der Heijden

[11] Patent Number: 4,499,402

[45] Date of Patent: Feb. 12, 1985

[54] COLOR DISPLAY TUBE

[75] Inventor: Antonius W. F. van der Heijden, Eindhoven, Netherlands

[73] Assignee: U.S. Philips Corporation, New York, N.Y.

[21] Appl. No.: 370,428

[22] Filed: Apr. 21, 1982

[30] Foreign Application Priority Data

May 22, 1981 [NL] Netherlands ..... 8102527

[51] Int. Cl.[3] ..... H01J 29/50; H01J 29/82

[52] U.S. Cl. ..... 313/414; 445/34; 445/36

[58] Field of Search ..... 313/412, 413, 414, 409, 313/425, 428, 417, 438, 356, 250, 256, 449; 445/29, 36, 33, 34

[56] References Cited

U.S. PATENT DOCUMENTS 3,771,002 11/1973 Standaart ..... 313/414 X
3,906,279 9/1975 Linssen ..... 313/414 X
4,366,419 12/1982 Barten ..... 313/414 X

*Primary Examiner*—Leo H. Boudreau
*Assistant Examiner*—K. Wieder
*Attorney, Agent, or Firm*—Robert J. Kraus

[57] ABSTRACT

An electron gun system for a three beam color display tube. Slot-shaped openings are provided in the sides of cup-shaped focusing electrodes of the system to facilitate alignment during assembly. The electrodes are stacked on a jig having a pin passing through central electron beam apertures of the respective electrodes. Arms having V-shaped ends are then passed through the slot-shaped openings until they engage collars of the electrodes which define the apertures in the respective electrodes.

2 Claims, 5 Drawing Figures

COLOR DISPLAY TUBE

BACKGROUND OF THE INVENTION

The invention relates to a colour display tube comprising, in an evacuated envelope, a display screen and an electron gun system which has first means to generate three electron beams situated in one plane and second means to focus the electron beams on the display screen. The second means comprises at least two focusing electrodes which are common for the three electron beams and which have apertures for each electron beam. The centres of the apertures for the central electron beam are situated on the axis of the central electron beam. The centres of the apertures for the two outermost electron beams are situated at various distances from the axis of the central electron beam. The apertures for the three electron beams are defined by collars, starting with the side of the first focusing electrode remote from the first means, taken in the forward direction of the electron beams.

Such a colour display tube having a so-called integrated electron gun system in which a number of electrodes are constructed in common for the three electron beams is disclosed in Netherlands patent application 7809160, which corresponds to U.S. Pat. No. 4,291,257. In this known electron gun system an asymmetrical lens field is generated between the first and second means. By said asymmetrical lens field the two outermost electron beams are deflected in the direction of the central electron beam in such manner that the three electron beams converge on the display screen. As a result of the apertures for the outermost electron beams in the focusing electrodes, which apertures are staggered relative to each other a symmetrical focusing of the outermost electron beams is obtained. As a result of this a variation of the voltage at the focusing electrodes, and hence a variation of the strength of the focusing lens, has no influence on the convergence of the electron beams.

In the embodiment shown in FIG. 6 of the abovementioned patent application the electron beams are focused on the display screen by means of one single focusing lens field generated by two focusing electrodes.

Furthermore, integrated electron gun systems are known in which the electron beams are focused on the display screen by means of several focusing lens fields and in which three or more focusing electrodes are present which can be electrically interconnected in various manners. U.S. Pat. No. 4,063,340 discloses an integrated electron gun system having four focusing electrodes with which three focusing lens fields are generated. The focusing electrode which is last in the forward direction of the electron beams is at a high voltage potential. The first and third focusing electrodes are electrically interconnected and are at a potential which is approximately 40% of the high voltage potential. The second focusing electrode is at a potential which is approximately 25% of the high voltage potential. Furthermore, U.S. Pat. No. 3,863,091 discloses an electron gun system having four focusing electrodes in which the second and fourth focusing electrodes are electrically interconnected and are at a high voltage potential. The first and third focusing electrodes are electrically interconnected and are at a potential which is approximately 40% of the high voltage potential.

An electron gun system of the so-called unipotential type having three focusing electrodes of which the first and third focusing electrodes are electrically interconnected is known from U.S. Pat. No. 4,178,532. In such electron gun systems constructed with several focusing electrodes it is also desired for the convergence of the electron beams to be independent of the focusing of the electron beams. In integrated constructions, for that purpose, the apertures in the focusing electrodes for the outermost beams should be laterally staggered or shifted relative to each other analogous to the embodiment disclosed in Netherlands Patent Specification 7809160.

Assembling integrated electron gun systems is usually done by means of assembly pins connected in a jig which are threaded through the apertures of the electrodes. In integrated electron gun systems having apertures for the outermost electron beams in the focusing electrodes which are staggered relative to each other the pins for the apertures for the outermost electron beams should be provided with several eccentrics. However, such pins are difficult to manufacture and are hence expensive. Moreover, the size of the apertures in the various electrodes is restricted since after assembly of the electrodes it must be possible to remove the pins. The apertures in the various electrodes are preferably chosen to be as large as possible because the quality of the spot formed on the display screen by the electron beams improves as the diameters of the apertures become larger. Due to the tolerances in the dimensions of the apertures and the pitch between the apertures occurring during manufacture of the electrodes, the pins always have a slightly smaller diameter than the diameter of the apertures. As a result of this a certain positioning inaccuracy of the electrodes occurs which is largest when the pitch between the apertures is nominal.

SUMMARY OF THE INVENTION

It is therefore the object of the invention to provide a construction of an electron gun system having apertures for the outermost electron beams in the focusing electrodes which are staggered relative to each other, with which it is possible in a simple manner to assemble such electron gun systems accurately.

According to the invention, a colour display tube of a kind mentioned in the opening paragraph is characterized in that the common focusing electrodes are provided at least on one side with slot-shaped apertures at the area of the collars of the apertures for at least one of the outermost electron beams. As a result of said slot-shaped apertures the electron gun system can be accurately assembled in a simple manner. First the electrodes are placed on an assembly pin in the desired sequence, the pin extending through all the central apertures of the electrodes. The mutual distance between the electrodes is determined by spacing members provided between the electrodes. The electrodes are then positioned accurately by means of arms having V-shaped ends which are moved through the slot-shaped apertures in the electrodes until they abut against the collars. The position of the electrodes obtained in this manner is fixed in known manner by sealing the ends of suspension braces connected to the electrodes in insulating glass rods. The slot-shaped apertures need be provided in the wall of the electrodes for only one of the outermost electron beams. Preferably, however, slot-shaped apertures are provided in the focusing electrodes for the two outermost electron beams. As a result of this occurring tolerances in the location of the apertures for the electron beams are averaged over the two apertures for the outermost electron beams.

It is also possible to assemble the focusing electrodes which are formed by two beaker-shaped or cup-shaped portions engaging each other with their open ends before the actual assembly of the electron gun system. As a result of this, slot-shaped apertures need be provided in said focusing electrodes only at one end.

An embodiment of a colour display tube is characterized in that the slot-shaped apertures are situated between the ends of the collars defining the apertures in the focusing electrodes. The slot-shaped apertures may not extend below the collars since otherwise disturbance of the potential fields may occur as a result of charging of the glass wall of the neck of the display tube. The slot-shaped apertures need not be provided particularly accurately in the electrodes. The slot-shaped apertures may in principle be used in any type of integrated electron gun system. As a result of the slot-shaped apertures the electron gun system is particularly suitable for automatic assembly. Moreover, the electron gun systems of one type may be assembled on one assembly jig for the various display tube formats. In the case of other display tube formats, as a matter of fact, only the location of the apertures for the outermost electron beams in the focusing electrodes varies so that only the V-shaped arms must be inserted further or less far through the slot-shaped apertures so as to abut against the collars defining the apertures.

BRIEF DESCRIPTION OF THE DRAWING

The invention will now be described in greater detail, by way of example, with reference to the accompanying drawing, of which

DESCRIPTION OF THE PREFERRED EMBODIMENT

Figure 1:
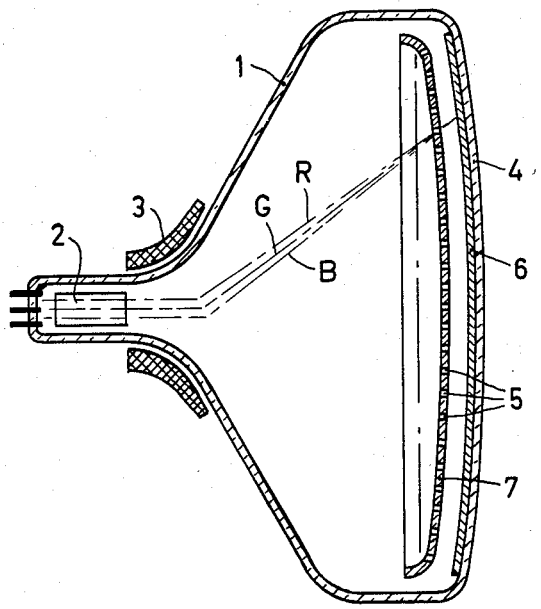
FIG. 1 is a sectional view of a colour display tube according to the invention.

The colour display tube according to the invention shown in FIG. 1 comprises in an evacuated envelope 1 an electron gun system 2 shown diagrammatically for generating three electron beams denoted by R, G and B. The three electron beams are deflected by means of a system of deflection coils 3 placed coaxially around the tube axis and they intersect each other at the area of a shadow mask 5 which is connected at a short distance from the display window 4. The display window 4 comprises a display screen 6 which is formed by a pattern of phosphors luminescing in the colours red, green and blue. The shadow mask 5 comprises a large number of apertures 7 and is positioned with respect to the display screen 6 in such manner that each of the electron beams is associated with phosphor regions of one colour.

Figure 2:
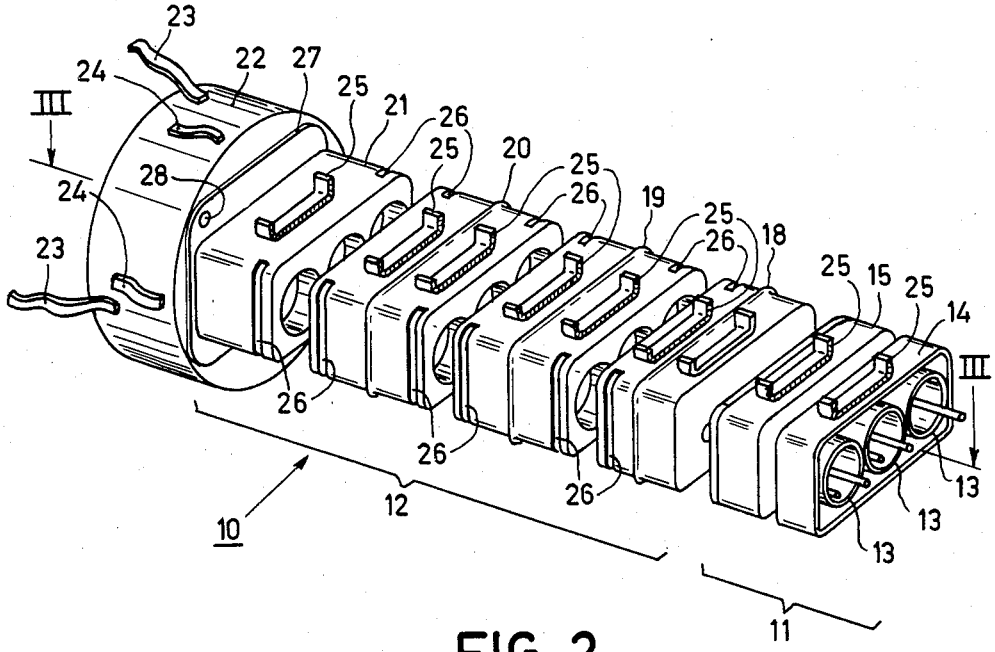
FIG. 2 shows an embodiment of an electron gun system for the tube shown in FIG. 1.

FIG. 2 shows diagrammatically an embodiment of an electron gun system for a display tube in accordance with the invention. The electron gun system 10 comprises first means 11 to generate three electron beams situated in one plane and second means 12 to focus the electron beams on the display screen. The means 11 comprise three separate cathodes 13 and furthermore a common first electrode 14 and a common second electrode 15 which have apertures for the three electron beams. The means 12 are formed by four focusing electrodes 18, 19, 20 and 21 which are common for the three electron beams. The electrodes 18, 19 and 20 are each formed by two beaker-shaped portions engaging each other with their open ends. The electrodes 18, 19, 20 and 21 have slot-shaped apertures 26 which are used upon assembling the electron gun system 10, which will be explained in detail with reference to FIG. 4. A centring cup 22 is mounted on the electrode 21. The electrode 21 comprises a bent-over edge 27 having two diagonally oppositely located apertures 28 of which only one is visible in the Figure. Two apertures are also present in the bottom of the centring cup 22. During assembly of the centring cup 22 pins are threaded through said apertures after which the centring cup 22 is welded to the electrode 21. The centring cup 22 has contact springs 23 and centring springs 24. The contact springs 23 make electric contact with an electrically conductive layer provided internally on the tube wall. The centring springs 24 position the electron gun system 10 in the neck of the tube. The electrodes comprise suspension braces 25 the ends of which are sealed in insulating glass rods which are not shown to avoid complexity of the drawing. During operation of the tube the electrodes of the electron gun system 10 carry for example the following potentials:

| | |
|---|---|
| cathode 13 | 0–275 V |
| first electrode 14 | 0 V |
| second electrode 15 | 700 V |
| electrode 18 | 10 kV |
| electrode 19 | 25 kV |
| electrode 20 | 10 kV |
| electrode 21 | 25 kV. |

Figure 3:
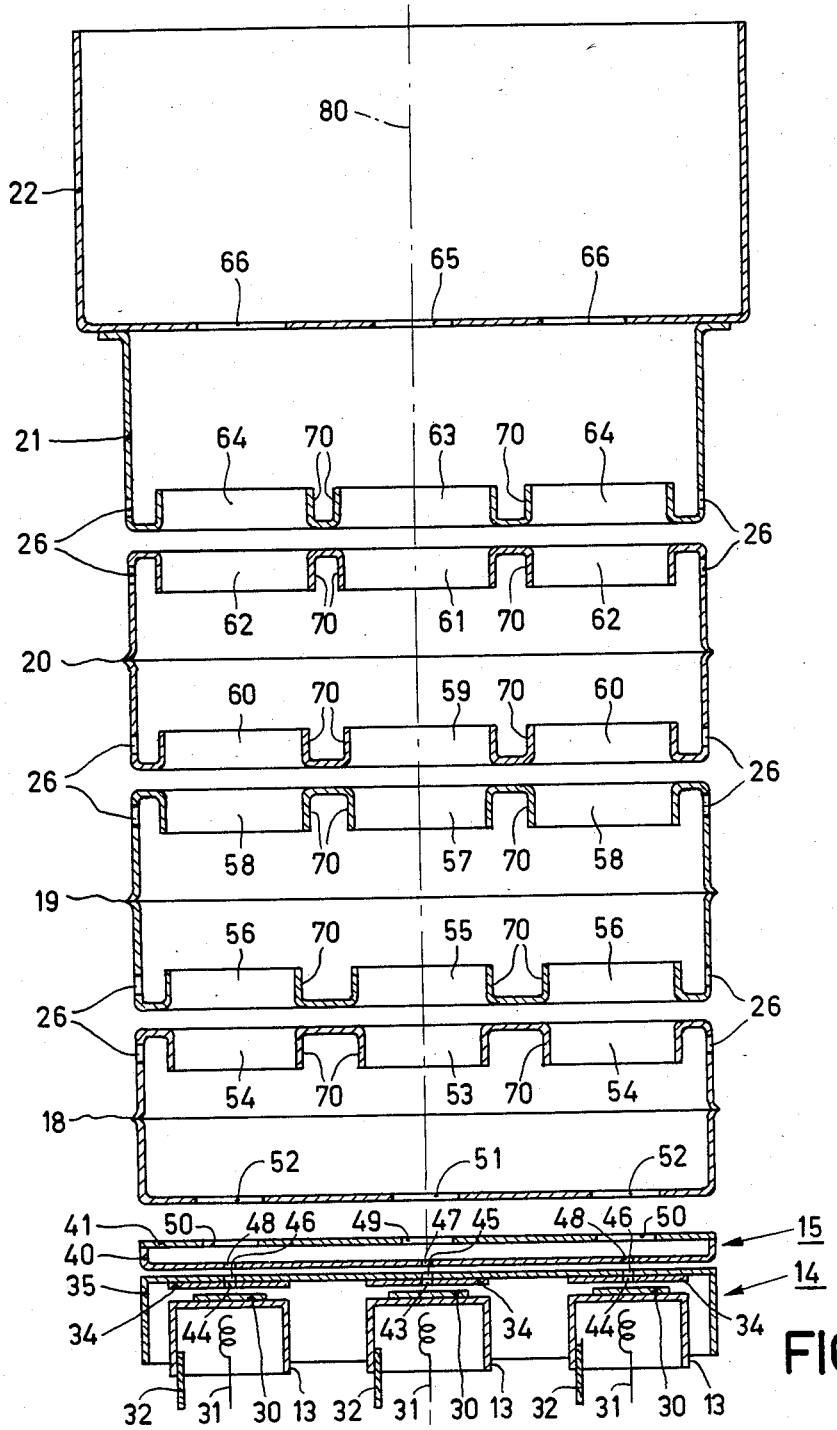
FIG. 3 is a sectional view taken on the line III—III of FIG. 2, and FIGS. 4*a* and *b* further illustrate the assembly of the electron gun system.

FIG. 3 is a diagrammatic longitudinal sectional view of the electron gun system shown in FIG. 2. The electron gun system comprises three cathodes 13 which are shown diagrammatically and the end face of which is coated with an emissive layer 30. A filament 31 is accommodated inside each cathode 13. A current supply conductor 32 is mounted to each cathode 13 to which the video signal for the relevant beam is supplied. At a distance of 0.075 mm from the cathode 13 a common first electrode 14 is provided. The electrode 14 is formed by a beaker-shaped portion 35 having a thickness of 0.2 mm. The cathodes 13 are welded to the upright edge of the portion 35. Three rectangular apertures are present in the beaker-shaped portion 35. In front of these apertures, three plates 34 having a thickness of 0.1 mm and having square apertures are secured in the beaker-shaped portions. As a result of this construction a quadrupole lens is generated at the area of the apertures in the first electrode 14. It is to be noted that this construction is known per se from Netherlands patent application 7712942 corresponding to U.K. patent application 2,008,851. At a distance of 0.3 mm from the first electrode 14 a second electrode 15 is present. This second electrode 15 is formed by a beaker-shaped portion 40 the bottom portion of which has apertures. An apertured plate 41 is provided at the open end of the beaker-shaped portion 40. The overall height of the second electrode 15 is 1.45 mm. At a distance of 1.4 mm from the second electrode 15 the first focusing electrode 18 is present. On the side facing the second electrode 15 the electrode 18 has three apertures for the three electron beams. In the table below are recorded the dimensions of the apertures in the first electrode 14, the second electrode 15 and the side of electrode 18 facing electrode 15, with the distance from the centres of the apertures to the axis 80 of the central electron beam.

| Electrode No | Aperture No | Dimensions (mm) | Distance to axis 80 (mm) |
|---|---|---|---|
| 14–34 | 43 | 0.7 × 0.7 | — |
| | 44 | 0.7 × 0.7 | 9.68 |
| –35 | 45 | 0.7 × 2.1 | — |
| | 46 | 0.7 × 2.1 | 9.68 |
| 15–40 | 47 | ø 0.7 | — |
| | 48 | ø 0.7 | 9.68 |
| 41 | 49 | ø 3.0 | — |
| | 50 | ø 3.0 | 9.68 |
| 18 | 51 | ø 3.3 | — |
| | 52 | ø 3.3 | 9.85 |

As appears from the above table the apertures 52 for the two outermost electron beams in the side of electrode 18 facing the second electrode 15 are eccentric with respect to the corresponding apertures 50 in the plate 41 of electrode 15. As a result of this an asymmetric lens field is formed between the facing sides of the second electrode 15 and the electrode 18, which field deflects the outermost electron beams towards the central electron beam in such manner that the three electron beams converge on the display screen. It is to be noted that the asymmetrical lens field for converging the electron beams can also be obtained by placing the apertures 48 and the apertures 50 for the outermost electron beams in the second electrode 15 eccentrically with respect to the corresponding apertures in the first electrode 14.

After the electron beams have been deflected over the convergence angle they are focused on the display screen by a number of successive focusing lens fields. The focusing lens fields are formed between the facing sides of the electrodes 18 and 19, 19 and 20, and 20 and 21. The electrode 18 on the side facing the electrode 19 and the electrodes 19, 20 and 21 comprise apertures for the three electron beams having collars 70. Of these electrodes and of the centring cup 22 the diameters of the apertures and the distances from the centres to the axis 80 of the central electron beam are stated in the table below. The mutual distance between the focusing electrodes is 1.0 mm. It is to be noted that in case of other dimensions of the electrodes other diameters and other axis dimensions are necessary.

| Electrode No | length (mm) | Aperture No | diameter (mm) | Distance to axis 80 (mm) |
|---|---|---|---|---|
| 18 | 8.8 | 53 | 5.45 | — |
| | | 54 | 5.45 | 9.56 |
| 19 | 10.7 | 55 | 5.57 | — |
| | | 56 | 5.57 | 9.62 |
| | | 57 | 6.37 | — |
| | | 58 | 6.37 | 9.21 |
| 20 | 10.7 | 59 | 6.51 | — |
| | | 60 | 6.51 | 9.28 |
| | | 61 | 7.34 | — |
| | | 62 | 7.34 | 8.87 |
| 21 | 8.0 | 63 | 7.50 | — |
| | | 64 | 7.50 | 8.95 |
| 22 | 13.0 | 65 | 3.50 | — |
| | | 66 | 3.50 | 8.85 |

As appears from the above table and from FIG. 3 the centres of the apertures for the outermost electron beams in the focusing electrodes are at different distances from the axis 80 of the central electron beam. As a result of this location of the apertures asymmetrical focusing lens fields are generated for the outermost electron beams, which fields are at right angles to the axis of the outermost electron beams already deflected over the convergence angle. As a result of this, small variations in the voltages of the focusing electrodes only influence the focusing of the electron beams and do not influence the convergence of the electron beams. A convergence of the electron beams independent of the focusing is of particular importance for those systems in which convergence errors are corrected by means of a ring of magnetic material placed in the neck of the display tube, which ring is magnetized permanently as a multipole from without dependent on the desired corrections. In this case it is not possible to readjust the convergence of the electron beams from without in the case of variations in the focusing voltages.

The apertures in the focusing electrodes have collars 70 which have a length of approximately 2 mm. The electrodes 18, 19, 20 and 21 have slot-shaped apertures 26 at the level of the collars 70 of the apertures for the outermost electron beams. These slot-shaped apertures 26 are provided so as to enable a simple and accurate assembly of the electron gun system 10.

Figure 4A:
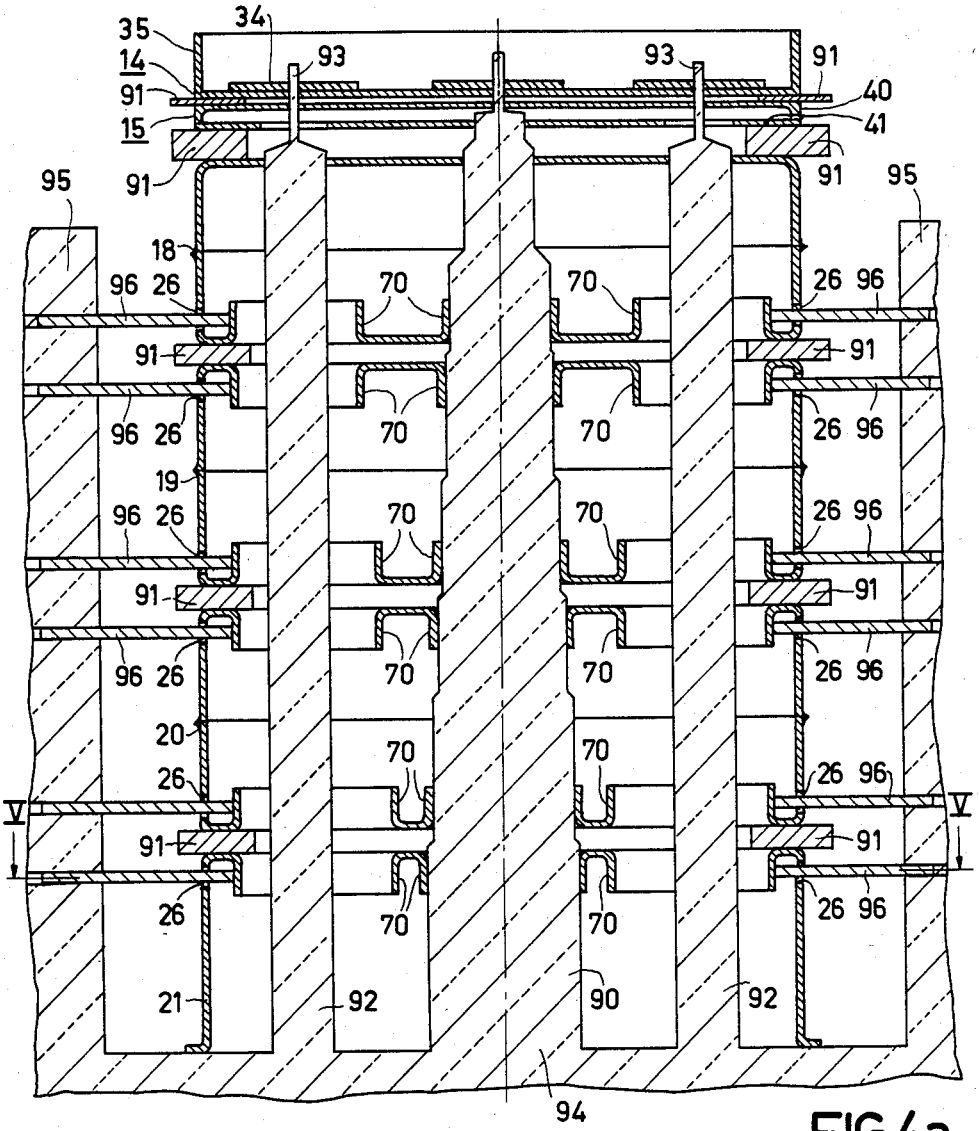

FIG. 4*a* shows the electron gun system during assembly. The electrode 21, the beaker-shaped portions of the electrodes 20, 19 and 18, the second electrode 15 and the first electrode 14 are successively slid with their central apertures on an assembly pin 90 which forms part of a jig 94 with the interposition of spacers 91. The first electrode 14 was previously assembled in a separate jig from the beaker-shaped portion 35 and the plate 34. The second electrode 15 was also previously assembled in a separate jig from the beaker-shaped portion 40 and the plate 41.

The first electrode 14 and the second electrode 15 are positioned with respect to the beaker-shaped portion of electrode 18 facing the second electrode 15 by means of two pins 92 which extend through the outermost apertures in the focusing electrode. The pins 92 have eccentrically placed portions 93 extending through the apertures for the outermost electron beams in the beaker-shaped portion 40 of the second electrode 15 and through the apertures for the outermost electron beams in the plates 34 of the electrode 14. The jig 94 has two slotted upright parts 95 in which arms 96 with V-shaped ends can be reciprocated by means of a driving mechanism not shown.

Figure 4B:
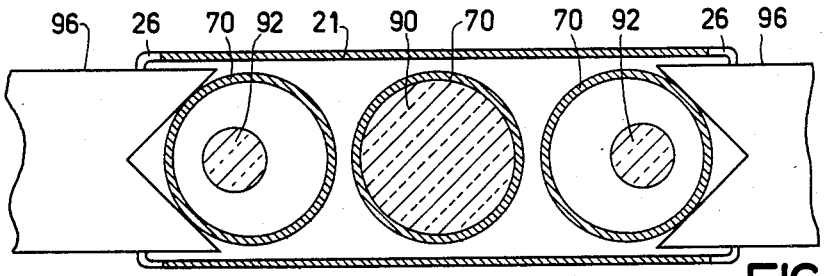

The arms 96 are passed through the slot-shaped apertures 26 until they abut against the collars 70 of the apertures for the outermost electron beams. In this position the position of the electrodes is fixed by sealing the ends of the suspension braces connected to the electrodes in insulated glass rods. FIG. 4*b* which is a sectional view taken on the line V—V of FIG. 4*a* shows how the V-shaped ends of arms 96 abut against the collars 70 of the apertures. After sealing the glass rods the electrode assembly is removed from the jig 94 and the cathodes are welded to the upright edge of the beaker-shaped portion 35 of the electrode 14 and the centring cup is welded to the electrode 21 in the manner already described.

The slot-shaped apertures 26 need not be provided accurately in the electrodes since they only serve as a passage for the arms 96. However, the slot-shaped apertures 26 may not extend below the collars 70 since otherwise as a result of charge of the glass wall of the neck of the display tube disturbances of the lens fields may occur. The assembly system shown is particularly suitable for automatic assembly of the electron gun system. Moreover, the electron gun systems for the various display tube formats can be manufactured on one jig. For guns for different display tube formations, only the location of the apertures for the outermost electron beams varies so that only the arms 96 must be inserted farther or less far through the slot-shaped apertures to abut against the collars of the apertures. In the embodiment shown, slot-shaped apertures are present in the electrodes for the two outermost electron beams. This has for its advantage that tolerances occurring in the location of the apertures are averaged between the two outermost electron beams. However, it is possible to provide the slot-shaped apertures for only one of the outermost electron beams. In principle it is also possible to assemble the electrodes 18, 19 and 20 in separate jigs from the beaker-shaped portions prior to the actual gun assembly. As a result of this, slot-shaped apertures 26 need be provided only at one end in the electrodes 18, 19 and 20. In addition to the embodiment shown the invention may be used in any type of integrated electron gun system having apertures in the focusing electrodes which are staggered relative to each other.

What is claimed is:

1. A color display tube comprising an envelope containing a display screen and an electron gun system for producing three electron beams directed at said screen, said electron gun system including a plurality of cup-shaped focusing electrodes successively-arranged along a longitudinal axis of the tube, each focusing electrode having an aperture centered on the axis for passing a central one of the electron beams and having two outer apertures for passing the other two electron beams, the outer apertures in at least one of the focusing electrodes being laterally-shifted with respect to the corresponding apertures in another one of the focusing electrodes for passing the same electron beams, said laterally-shifted apertures being defined by axially-extending collars, characterized in that a side of said cup-shaped focusing electrode having the laterally-shifted apertures includes at least one slot-shaped opening to facilitate passage, during assembly of the electrodes, of an arm having a shaped end for engaging one of said collars and for positioning the respective laterally-shifted aperture relative to the corresponding aperture in said other focusing electrode.

2. A color display tube as in claim 1 where said slot-shaped opening is directly opposite from a side of the respective collar which is remote from the longitudinal axis and has an axial width which does not exceed that of said respective collar.

* * * * *